United States Patent [19]

Weaver et al.

[11] Patent Number: 4,557,375

[45] Date of Patent: Dec. 10, 1985

[54] MULTI-PACKAGING DEVICE

[75] Inventors: William N. Weaver, Northbrook; Robert C. Olsen, Streamwood, both of Ill.

[73] Assignee: Illinois Tool Works Inc., Chicago, Ill.

[21] Appl. No.: 637,625

[22] Filed: Aug. 3, 1984

[51] Int. Cl.[4] ..... B65D 85/72

[52] U.S. Cl. ..... 206/151; 206/150; 206/161; 206/427; 294/87.2

[58] Field of Search ..... 206/145–158, 206/427, 161; 294/87.2, 87.28

[56] References Cited

U.S. PATENT DOCUMENTS

| | | | |
|---|---|---|---|
| 3,268,070 | 8/1966 | Cunningham | 206/150 |
| 3,341,245 | 9/1967 | Wolford | 206/150 X |
| 3,443,685 | 5/1969 | Wanderer | 294/87.2 |
| 4,003,457 | 7/1977 | Weaver | 206/150 X |
| 4,219,117 | 8/1980 | Weaver et al. | 206/150 |
| 4,356,914 | 11/1982 | Olsen et al. | 206/150 |
| 4,471,010 | 9/1984 | McBriarty | 206/150 X |

FOREIGN PATENT DOCUMENTS

| | | | |
|---|---|---|---|
| 960217 | 6/1964 | United Kingdom | 294/87.2 |

*Primary Examiner*—Allan N. Shoap
*Assistant Examiner*—Bryon Gehman
*Attorney, Agent, or Firm*—Thomas W. Buckman

[57] ABSTRACT

A multi-packaging device for bottles which utilizes a single sheet-like resilient carrier device positioned about the body of bottles and individually gripping each of the bottles. A pair of handles are created in diagonally opposite end rank apertures in the device and apertures laterally adjacent the handle apertures include web structures to compensate for the presence of the handles when lateral stretching forces are applied solely to the outer margins of the carrier device.

6 Claims, 4 Drawing Figures

FIG. 2
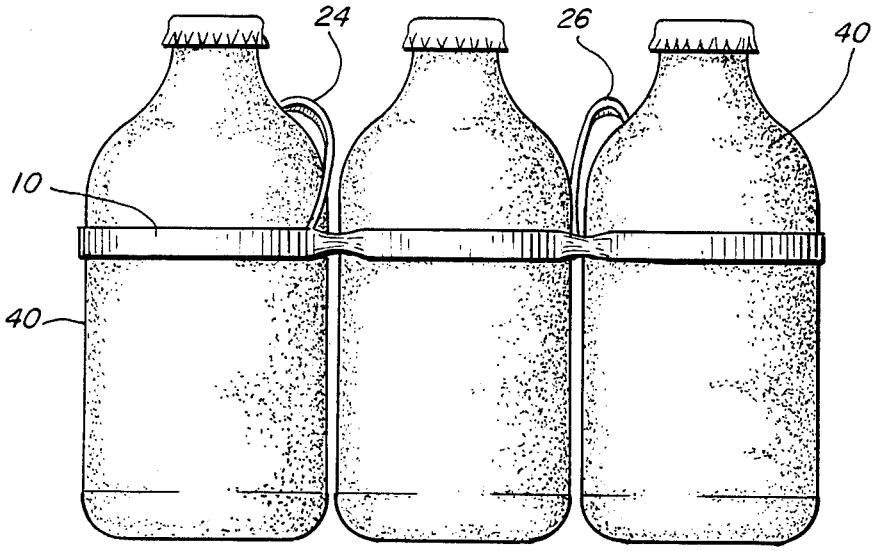
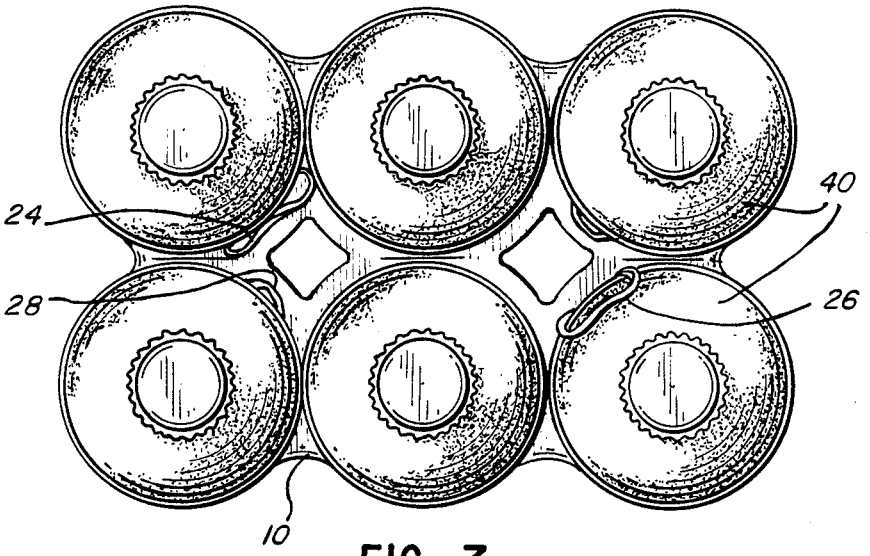
FIG. 3

MULTI-PACKAGING DEVICE

BACKGROUND AND SUMMARY OF THE INVENTION

This invention is concerned with packages of bottles and the like and more particularly carrier devices. Heretofore, bottle type containers have been assembled in multi-packages through various forms of carriers and containers. The containers in the prior art packages are typically arrayed in a rank and row relationship and usually have two parallel rows of three ranks and are retained in that array for handling.

Paperboard wraparound or partial wrap around are one manner of creating multi-packages in the prior art. Other packaging concepts utilized include a top-grouping carrier of plastic type material or cardboard material. Many other efforts to produce a multi-package include a two-part device such as a band member around the periphery of the array in conjunction with a flexible resilient member joining the necks of the bottles.

Recently co-pending application Ser. Nos. 542,879 and 553,004 have described one-piece flexible plastic devices with handle means designed to extend upwardly of the plane of the device and create an effective means to carry such containers. More particularly the device shown in Ser. No. 553,004 describes a one-piece device with handle loops created in diagonally opposing end rank apertures which are designed to move upwardly from the plane of the device when a bottle is positioned therein. Since the handles in such a device are not located on the longitudinal center line an application technique which uses a central blade as shown in U.S. Pat. No. 4,250,682 can be utilized.

However, it has been found that when an application technique which is also described in the above mentioned patent is utilized, namely, stretching the device solely through jaws located at the outer margin of the carrier, the presence of handles in the apertures may cause some undesirable stretch patterns for the device which in high speed applicating systems may create application and functional problems.

SUMMARY OF THE INVENTION

The carrier device of the present invention is thus particularly designed for packaging of bottles or the like in closely spaced rows and more particularly is created to include finger gripping or handle means which extend upwardly from the plane of location on the device to a position which will provide the user or handler of such package with a suitable handle even though the device may be situated directly adjacent the neck regions of the bottles. More precisely the carrier device is designed to be an improvement of carrier devices which utilize handle means extending from within the periphery of apertures in the device.

It is therefore an object of the invention to provide a multi-packaging device having handles located in only one of a pair of laterally adjacent apertures and some means in the other of said pair of apertures to compensate for the unequal forces applied only at the marginal edges of the device.

A further object of the invention is to provide a multi-packaging device that creates an inherently stable package that uniformly grips containers held thereby.

The above and other objects of the invention will be apparent and fully pointed out in the detailed description and accompanying drawings in which FIG. 1 is a plan view of the preferred embodiment of the carrier device of this invention.

FIG. 2 is a side view of a multi-package which includes the device shown in FIG. 1.

FIG. 3 is a top plan view of the multi-package which incorporates the packaging device of FIG. 1.

DETAILED DESCRIPTION OF THE PREFERRED EMBODIMENT

Figure 1:
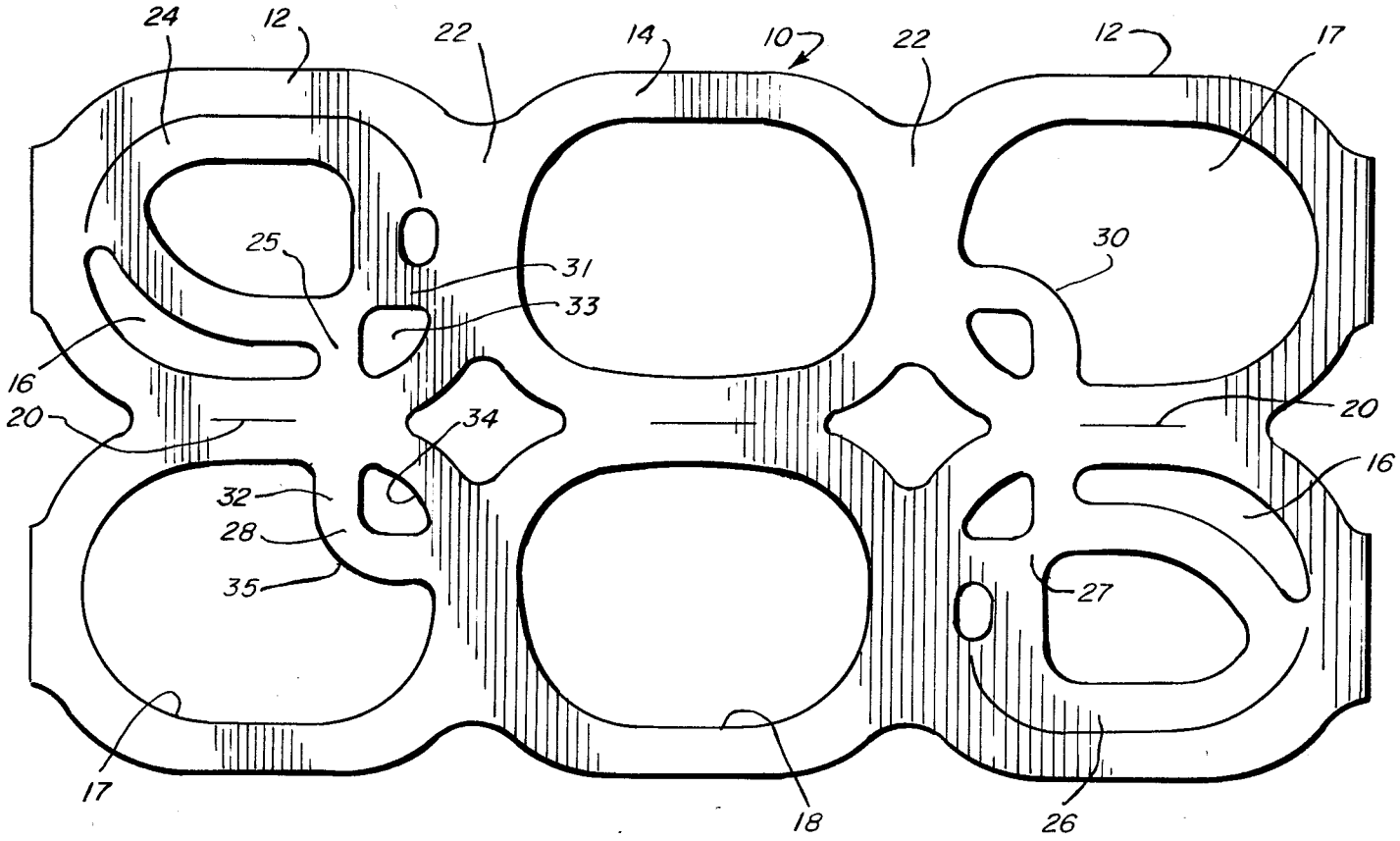

Referring to the accompanying drawings and in particular FIG. 1 at this time. One form of the carrier device is shown before packaging the bottles. The carrier device 10 includes a plurality of apertures arranged generally in ranks and rows and created by a series of interconnected bands. It should be noted that apertures 16 are identified as those created by bands 12 which are the end most ranks of apertures and bands in the device 10 while apertures 18 are created by bands 14 which is the central most rank in the device 10.

Carrier device 10 therefore typically is arranged to include three ranks of two longitudinal rows of apertures and bands. The rows are interconnected by lateral web means 20 while the rows are interconnected by longitudinal web means 22.

As in co-pending Ser. No. 553,004, one aperture in each of the end ranks includes a handle or loop structure integrally connected and emanating from the radially innermost quadrant of an aperture. More particularly the two handles in each device are located on opposite sides of the longitudinal center line of the device and in diagonally opposing end rank apertures.

In FIG. 1 for example, handle means 24 and 26 are shown located in diagonally opposing end rank apertures 16. Attention is directed to the end rank apertures 17 which are laterally adjacent aperture 16. The apertures 17 are provided with a force compensating web structure 28 or 30 in the radial innermost quadrant, i.e. between adjacent longitudinal web 20 and lateral web 22. It should also be noted that the handle means 24 or 26 in apertures 16 are connected to the band 12 in the radial innermost quadrant thereof i.e., between adjacent longitudinal web 20 and lateral web 22, by a hinge structure 25 or 27. Hinge structures 25 and 26 and web structure 28 and 30 are designed to be substantially identical.

A brief description of the preferred technique of carrier application will illustrate the advantages of connected and emanating from the radially innermost quadrant of an aperture. More particularly the two handles in each device are located on opposite sides of the longitudinal center line of the device and in diagonally opposing end rank apertures.

In FIG. 1 for example, handle means 24 and 26 are shown located in diagonally opposing end rank apertures 16. Attention is directed to the end rank apertures 17 which are laterally adjacent aperture 16. The apertures 17 are provided with a force compensating web structure 28 or 30 in the radial innermost quadrant, i.e. between adjacent longitudinal web 20 and lateral web 22. It should also be noted that the handle means 24 or 26 in apertures 16 are connected to the band 12 in the radial innermost quadrant thereof i.e., between adjacent longitudinal web 20 and lateral web 22, by a hinge structure 25 or 27. Hinge structures 25 and 26 and web structure 28 and 30 are designed to be substantially identical.

A brief description of the preferred technique of carrier application will illustrate the advantages of this invention. A typical application of a carrier 10 to bottle 40 utilizes laterally opposing jaws which are inserted at the outer margin of each of the bands 12 and 14. Stretching forces are than applied to each rank through the opposing jaws. These substantially equal and opposite stretching forces are resisted and counteracted solely by the lateral webs 20. If only one of the apertures in the end ranks included a mass of plastic, such a handle and associated hinge means, between the lateral web 20 and the longitudinal web 22, the lateral webs 20 would tend to shift during the stretching process. In such a situation, there would be less resistance to stretch in the aperture adjacent the aperture that includes the handle and thus the web 20 shifts laterally away from the center line of the stretched device to be repositioned on the side of the adjusted centerline that also includes the handle. The end rank aperture that is adjacent the handle aperture thus would be stretched to be a slightly larger perimeter than the opposing apertures. When one views the device of FIG. 1 it is apparent that the lateral webs 20 would not only shift but would shift to opposite sides of the center line due to the diagonally opposing position of the handle. This distortion, of course, would occur absent the features of this invention, accordingly, the webs 20 on the left side of FIG. 1 would be shifted upwardly as shown in the drawing while webs 20 in the right side of the drawing would be shifted downwardly as shown in FIG. 1. In high speed applicating systems the accuracy of the location of the holes and webs just discussed is critical and thus some stabilization of the central web is necessary.

It has been found that the hinge structure 25 and 27 absorbs the stretch and creates the distortion that was just described and that the inclusion of a similar mass of plastic with force resisting characteristics in the laterally adjacent aperture will stabilize the stretching. Force compensating webs 28 and 30 are therefore positioned in the quadrant of apertures 16 directly adjacent the hinge means 25 and 27.

A preferred embodiment of the invention includes an aperture in the hinge which connects the loop or handle means to the region between longitudinal and lateral webs which tends to permit the handle to lay or to be positioned away from the side of the bottles and towards the center line of the package. If the hinge is solid the loop tends to lay flat against the bottle and may be more difficult to grasp and to handle. Thus preferred hinge means 25 and 27 are created with a pair of substantially identical circumferentially spaced legs 31, creating an aperture 33 between such legs and the associated band region. Consequently, in order to provide substantially identical stretch receiving characteristics in the device, the force compensating web means 28 and 30 are also designed to have circumferentially spaced leg means 32 interconnecting an arcuate section 35 and creating an aperture means 34. In the preferred embodiment the apertures 33 and 34 are triangular shaped.

Figure 4:
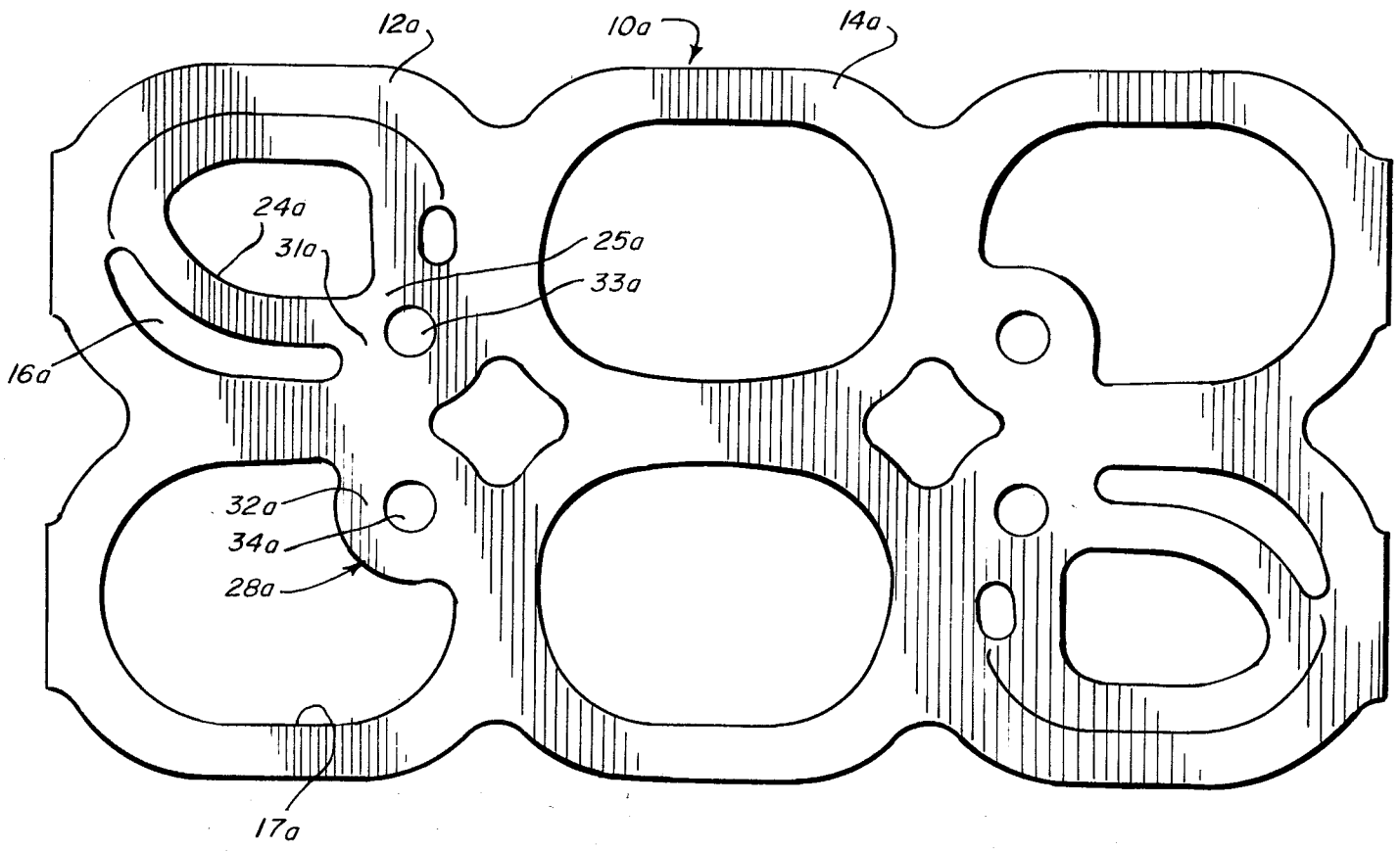
FIG. 4 is a plan view of an alternate embodiment of the carrier of this invention.

However, as shown in FIG. 4, an alternate embodiment of the hinge and force compensating leg means may be designed to create apertures 33*a* and 34*a* which are substantially circular. Except for this difference, all features in the device shown in FIG. 4 are identical to the device shown in FIG. 1 and are identified by identical reference characters with the addition of the suffix "a".

A further advantage of maintaining the center line of the carrier device equidistant between the lateral edges of the device is the resulting capability of the webs 20 to uniformly form a generally V-shaped cross-section in the completed package. This structure provides surface contact substantially completely around each of the bottles. If the lateral web 20 were to shift as discussed above, the web material 20 would primarily embrace one of the pair of bottles and be substantially out of surface contact with the other of said pair of bottles. Thus the package integrity of such a device described by this invention is enhanced.

It will be understood that there are and maybe other many variations and modifications utilizing this invention without departing from the spirit and scope of the novel concept disclosed and claimed herein.

We claim:

1. A package making device for unitizing a plurality of containers, the device formed from a resilient elastic deformable sheet of plastic material and comprising at least two rows and three ranks of integrally connected bands creating reconfigurable container receiving and gripping apertures, a longitudinal axis defined substantially midway between the lateral edges of the device, the rows being situated on opposing sides of said longitudinal axis and being non-symmetrical relative to said longitudinal axis, a plurality of rank axes perpendicularly disposed to said longitudinal axis, lateral web means lying on the longitudinal axis integrally connecting pairs of adjacent apertures in a given rank, longitudinally web means integrally connecting pairs of adjacent apertures in a given row, a pair of finger gripping loop members each extending from the inner margin of diagonally opposite apertures in the end ranks of the device, each loop member emanating from and secured by hinge means to a corner quadrant at the inner margin of said diagonally opposite apertures which is between the lateral and longitudinal web means associated with one of a pair of apertures in the end ranks apertures, the other of each pair of end rank apertures including force compensating web means extending thereinto from corner quadrants of said other pair of end rank apertures which are also between the lateral and longitudinal web means associated therewith, the hinge means and force compensating web means being on opposing sides of the longitudinal axis but laterally adjacent to each other to create similar stretch characteristics in the associated bands when lateral stretching forces are applied at the outer margins of the device.

2. The package making device of claim 1 wherein the hinge means securing the loop members to the associated apertures comprises a pair of circumferentially spaced leg means and the force compensating web means also includes pair of circumferentially spaced leg means interconnected by an arcuate band segment.

3. The package making device of claim 2 wherein the space created by the leg means in both the hinge and force compensating web means is generally triangular.

4. The package making device of claim 2 wherein the space created by the leg means in both the hinge and force compensating web means is generally circular.

5. The package making device of claim 2 wherein the hinge means and laterally opposed force compensating web means are substantially identical in size and shape.

6. The package making device of claim 1 wherein the bands and apertures created thereby are substantially identical in size and shape.

* * * * *